US011046337B2

(12) United States Patent
Pfannschmidt

(10) Patent No.: US 11,046,337 B2
(45) Date of Patent: Jun. 29, 2021

(54) DOUBLE AXLE DRIVE

(71) Applicant: Siemens Aktiengesellschaft, Munich (DE)

(72) Inventor: Bernd Pfannschmidt, Rosstal (DE)

(73) Assignee: SIEMENS MOBILITY GMBH, Munich (DE)

( * ) Notice: Subject to any disclaimer, the term of this patent is extended or adjusted under 35 U.S.C. 154(b) by 370 days.

(21) Appl. No.: 16/072,743

(22) PCT Filed: Jan. 11, 2017

(86) PCT No.: PCT/EP2017/050464
§ 371 (c)(1),
(2) Date: Jul. 25, 2018

(87) PCT Pub. No.: WO2017/129404
PCT Pub. Date: Aug. 3, 2017

(65) Prior Publication Data

US 2019/0031212 A1 Jan. 31, 2019

(30) Foreign Application Priority Data

Jan. 26, 2016 (EP) ..... 16152694

(51) Int. Cl.
*B61F 3/04* (2006.01)
*B61C 9/52* (2006.01)

(52) U.S. Cl.
CPC . *B61F 3/04* (2013.01); *B61C 9/52* (2013.01)

(58) Field of Classification Search
CPC ..... B61C 9/52; B61F 3/04
USPC ..... 105/117, 131, 136
See application file for complete search history.

(56) References Cited

U.S. PATENT DOCUMENTS 3,014,433 A * 12/1961 Durand ..... B61D 17/10 105/97
3,626,862 A * 12/1971 Korn ..... B61C 9/44 105/131
3,661,096 A * 5/1972 Kayserling ..... B61C 9/52 105/117
3,859,929 A * 1/1975 Korn ..... B61C 9/44 105/131

(Continued)

FOREIGN PATENT DOCUMENTS

DE 3047413 7/1982
DE 3217301 11/1983

(Continued)

OTHER PUBLICATIONS

PCT International Search Report and Written Opinion of International Searching Authority dated Feb. 5, 2017 corresponding to PCT International Application No. PCT/EP2017/050464 filed Nov. 1, 2017.

(Continued)

*Primary Examiner* — Zachary L Kuhfuss
(74) *Attorney, Agent, or Firm* — Cozen O'Connor

(57) ABSTRACT

A double axle drive includes at least one driving motor arranged between two drive axles, wherein the axis of rotation thereof extends transversely, in particular perpendicularly to the drive axles, where a wheel set shaft is drivable via a drive shaft of the driving motor via each transmission, and where the entire double axel drive is arranged in a housing unit that includes two housing parts.

8 Claims, 2 Drawing Sheets

(56) References Cited

U.S. PATENT DOCUMENTS 4,130,065 A * 12/1978 Susdorf ..... B61C 9/50 105/131
4,148,262 A * 4/1979 Eichinger ..... B61C 9/44 105/109
4,278,027 A * 7/1981 Eichinger ..... B61C 9/50 105/117
4,409,904 A * 10/1983 Eichinger ..... B61C 9/44 105/131
4,461,217 A * 7/1984 Girod ..... B61C 9/50 105/135
4,461,218 A * 7/1984 Kuhlow ..... B61C 9/52 105/137
4,498,562 A * 2/1985 Piepenbreier ..... B61C 9/50 105/131
4,510,395 A * 4/1985 Sohrt ..... B61C 9/50 290/3
4,664,037 A * 5/1987 Piepenbreier ..... B61C 9/44 105/131
4,697,527 A * 10/1987 Eichinger ..... B61C 9/50 105/131
4,790,248 A * 12/1988 Piepenbreier ..... F16D 3/62 105/131

FOREIGN PATENT DOCUMENTS

DE 3600675 A1 * 7/1987 ..... B61F 3/04
DE 3624684 A1 * 1/1988 ..... B61C 9/38
DE 8814798 3/1990
EP 54134 A1 * 10/1981 ..... B61C 9/50
EP 0054134 6/1982
EP 81640 A1 * 10/1982 ..... B61C 9/52
EP 0718170 6/1996
EP 1685014 B1 6/2008
RU 2322366 C1 4/2008

OTHER PUBLICATIONS

Office Action dated Apr. 19, 2019 issued in Chinese Patent Application No. 201780008257.3.

* cited by examiner

DOUBLE AXLE DRIVE

CROSS-REFERENCE TO RELATED APPLICATIONS

This is a U.S. national stage of application No. PCT/EP2017/050464 filed Jan. 11, 2017. Priority is claimed on EP application No. 16152694 filed Jan. 26, 2016, the content of which is incorporated herein by reference in its entirety.

BACKGROUND OF THE INVENTION

1. Field of the Invention

The invention relates to rail vehicles and, more particularly, to a double axle drive.

2. Description of the Related Art

In rail vehicles with longitudinal drives, center drives or one external longitudinal drive in each case, i.e., "double axle drives", an axle transmission is mounted on a drive motor at the respective ends of its rotor shaft as a drive for a wheel or a wheel set, resulting in a multipart housing construction.

The housing of the drive motor of such a longitudinal drive has hitherto merely contained a bearing shield, where the transmissions each have a separate housing with a transmission cover and thus the entire construction of the double axle drive consists of several parts, in particular housing parts, as is apparent, for example, from EP 0 718 170 A1.

DE 32 17 301 A1 discloses a drive for electric rail vehicles, in which a drive motor lying longitudinally between two drive axles drives the drive axles via angular transmissions.

EP 0 718 170 A1 shows a chassis for rail vehicles having two parallel longitudinal supports that are connected to one another by at least one transverse support.

DE 30 47 413 A1 discloses a double axel drive for rail vehicles having wheel sets mounted in a bogie or frame and an electric motor lying between these in the direction of travel.

DE 88 14 798 U1 likewise discloses a double axel drive for rail vehicles.

SUMMARY OF THE INVENTION

On the foregoing basis, it is an object of the invention to simplify a double axle drive with respect to its structure and to create a corresponding chassis for a rail vehicle.

This and other objects and advantages are achieved in accordance with the invention by a double axle drive having at least one drive motor arranged between two drive axles, where the axis of rotation of the drive motor extends transversely, in particular perpendicularly to the drive axles, where a wheel set shaft can be driven via a drive shaft of the drive motor via each transmission, and where the entire double axle drive is arranged in a housing unit that has two housing sections.

In accordance with the invention, only one housing unit is now provided between the two drive axles, with the housing unit now containing components of the drive motor, the bearing, the clutch and two transmissions, such that the production and assembly costs and also the weight are reduced in comparison to the weight of conventional double axle drives.

In this case, the transmission is advantageously formed as a hypoid gear or as a normal angular gear. These compact transmissions are particularly suitable for such double axle drives, because at this location the force flow can be virtually ideally deflected in a very confined space. In order to now connect the two housing sections to one another in a force-fit manner, flange surfaces at which these two housing parts can be connected are formed at the butt joints.

Advantageously, these flange surfaces extend perpendicularly to the drive shaft of the rotor of the drive motor or parallel to the drive axles. The production of such flange surfaces is thereby simplified.

To ensure the stator laminated core of the drive motor has an uninterrupted seating in the housing, the flange surfaces are provided externally to, in particular, axially externally to the stator laminated core. This also simplifies the shrink fit of the stator laminated core inside the housing section provided therefor. The torques acting on the stator laminated core in operation of the double axle drive are thereby better absorbed. The ability to disassemble the respective housing sections is also thereby maintained.

In a chassis of a rail vehicle having at least one double axle drive a compact structure is now created with a comparatively low weight, and the cost of this type of chassis is reduced.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The invention plus other advantageous embodiments of the invention are explained in greater detail below using basic illustrations of exemplary embodiments, in which.

DETAILED DESCRIPTION OF THE EXEMPLARY EMBODIMENTS

Figure 1:
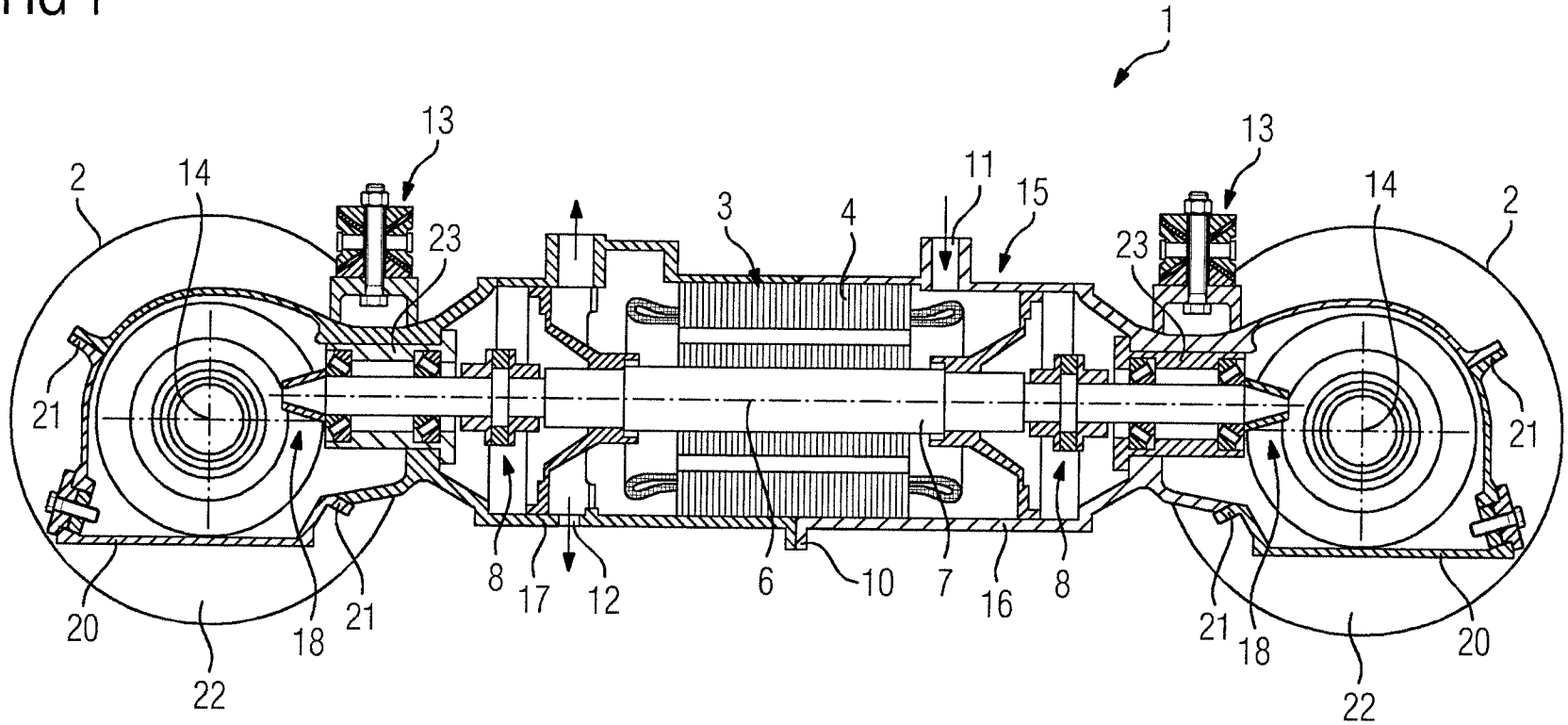
FIG. 1 shows a longitudinal section with a centrally arranged flange in accordance with the invention.

FIG. 1 shows a longitudinal section of a double axle drive, which is suitable both as a center drive and also as an external longitudinal drive, in particular for low-floor vehicles. In this case, a drive motor 3 is arranged between two drive axles 14 and has a stator laminated core 4 and a rotor laminated core 5 surrounding a rotor shaft 7. Here, the rotor shaft 7, which can rotate about an axis of rotation 6, is mounted via bearings 9. The stator laminated core 4 is accommodated in a rotatably fixed manner in a housing unit 15. The housing unit 15 is divided into two housing sections 16 and 17, which can be connected to one another on a flange surface 10. In the present case, the flange surface 10 of the flange is located in the region of the stator laminated core 4.

In each case, parts of the drive motor 3, clutch 8, bearing unit 23 for transmission 18 and drive motor 3 are in the housing sections 16, 17. In addition, a brake can be arranged in at least one of the housing sections 16, 17, in particular between clutch 8 and drive motor 3. Air guidance devices for cooling air flows can optionally be provided on or in the housing sections 16, 17, as also can coolant inlets 11 or coolant outlets 12 on the casing of the housing sections 16, 17.

Figure 2:
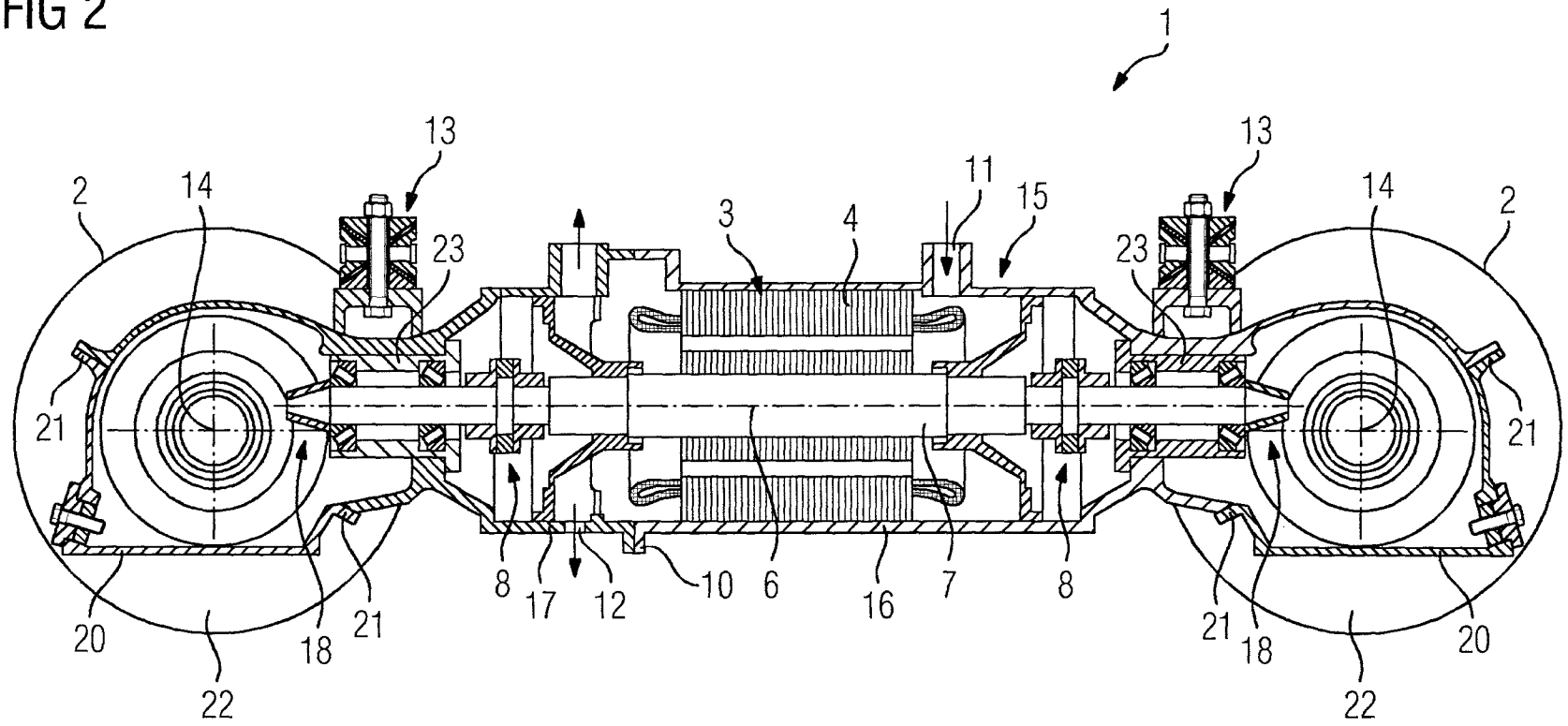
FIG. 2 shows a longitudinal section with an eccentrically arranged flange in accordance with an embodiment of the invention.

In an advantageous further embodiment shown in FIG. 2, the flange surfaces 10 of the flange are located axially externally to the stator laminated core 4. Thus, the stator laminated core 4 has an uninterrupted seating in a housing section. This simplifies the ability to disassemble the housing sections 16, 17. Thus, for example, electrical connections of the winding system of the drive motor 3 can be particularly favorably accessibly arranged on one side of the stator laminated core 4.

Arranged in the housing section 16 are, among other things, the drive motor 3, the clutch 8, a bearing unit 23 for transmission 18 and drive motor 3, and optionally a brake. Arranged in the other housing section 17 are the clutch 8 and a bearing unit 23 for the transmission 18. Air guidance devices for cooling air flows can, in each case, optionally be provided on or in the housing sections 16, 17, as also can coolant inlets 11 or coolant outlets 12 on the casing of the housing sections 16, 17.

In the housing unit 15, in particular in the housing sections 16 and 17, air inlets 11 and/or air outlets 12 are each provided in the wall of the housing sections 16, 17. Likewise, in each case, a clutch 8, both to one drive axle 14 and also to the other drive axle 14, is arranged inside the housing unit 15. The entire housing unit 15 is positioned via springs 13 in a bogie (not shown in greater detail) of a rail vehicle.

The respective housing sections 16, 17 likewise each accommodate the bearing arrangements 12 in corresponding bearing seats of the housing sections 16, 17, which are preferably located between transmission 18 and clutch 8.

The respective housing sections 16, 17 project axially (when viewed from the drive motor 3) above the drive axles 14. Here, the housing sections 16, 17 surround their respective drive axle 14 both in accordance with FIG. 1 and also in accordance with FIG. 2 up to 180 degrees. In other words, a notional extension of the flange surfaces of the flange 21 extends through the respective drive axle 14.

Assembly is comparatively simple even with angles of less than 180 degrees.

The housing sections 16, 17 are each closed by a transmission cover 20, which is attached to the respective housing section 16, 17 via flange connections 21. The transmission covers 20 each have a maintenance opening 22.

A wheel or a wheel set having two wheels is driven via the drive axle 14 via a transmission 18, in each case. The drive axle of the wheels or of the wheel sets in this case extends essentially perpendicularly to the axis of rotation 6 of the drive motor 3.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A double axle drive, comprising:

a plurality of drive axles; and a single drive motor having a stator laminated core arranged in a rotatably fixed manner within a single housing unit having two housing sections connected to one another at a flange surface in a region of the stator laminated core, said single drive motor being arranged between the plurality of drive axles, and an axis of rotation of said drive motor extending transversely to the plurality of drive axles;

wherein a wheel set shaft is drivable via a drive shaft of the single drive motor via each transmission; and wherein an entirety of the double axle drive is arranged in the single housing unit having the two housing sections.

2. The double axle drive as claimed in claim 1, wherein the transmission is an angular transmission or a hypoid transmission.

3. The double axle drive as claimed in claim 2, wherein the two housing sections have flange surfaces facing one another, upon which the two housing sections are fixable; and wherein the flange surfaces extend perpendicularly or parallel to the drive shaft.

4. The double axle drive as claimed in claim 1, wherein the two housing sections have flange surfaces facing one another, upon which the two housing sections are fixable; and wherein the flange surfaces extend perpendicularly or parallel to the drive shaft.

5. The double axle drive as claimed in claim 4, wherein the flange surface are arranged axially externally to a stator laminated core of the drive motor.

6. The double axle drive as claimed in claim 1, wherein the transverse direction is a direction perpendicular to the plurality of drive axles.

7. The double axle drive as claimed in claim 1, wherein one housing section of two housing sections includes a coolant inlet and another housing section of the two housing sections includes a plurality of outlets.

8. The double axle drive as claimed in claim 7, wherein the coolant inlet and the plurality of coolant outlets allow a coolant to flow across at least the stator laminated core.

* * * * *